US007721891B2

(12) United States Patent
Dubois

(10) Patent No.: US 7,721,891 B2
(45) Date of Patent: May 25, 2010

(54) NEST AND STACKED CONTAINERS

(75) Inventor: Jean-Marc Dubois, Bremgarten (CH)

(73) Assignee: George Utz Holding AG, Bremgarten (CH)

( * ) Notice: Subject to any disclaimer, the term of this patent is extended or adjusted under 35 U.S.C. 154(b) by 798 days.

(21) Appl. No.: 11/537,580

(22) Filed: Sep. 29, 2006

(65) Prior Publication Data

US 2007/0034540 A1 Feb. 15, 2007

(51) Int. Cl.
*B65D 21/032* (2006.01)
*B65D 21/00* (2006.01)

(52) U.S. Cl. ..... 206/507; 206/511; 220/669

(58) Field of Classification Search ..... 206/207, 206/501, 514, 505, 507, 511, 509; 220/669
See application file for complete search history.

(56) References Cited

U.S. PATENT DOCUMENTS

| | | | | | |
|---|---|---|---|---|---|
| 1,542,115 | A | * | 6/1925 | Weis | 220/23.2 |
| 3,117,692 | A | * | 1/1964 | Carpenter et al. | 206/508 |
| 3,201,035 | A | * | 8/1965 | Martin et al. | 232/1 R |
| RE26,758 | E | * | 1/1970 | Kreeger | 206/507 |
| 3,498,494 | A | * | 3/1970 | Voorhees, Jr. | 206/501 |
| 3,589,554 | A | * | 6/1971 | Smith | 220/23.83 |
| 4,105,117 | A | * | 8/1978 | Atkin et al. | 206/501 |
| 4,139,098 | A | * | 2/1979 | Mollon | 206/507 |
| 4,426,001 | A | * | 1/1984 | Stahl et al. | 206/507 |
| 4,863,222 | A | * | 9/1989 | Posso | 312/107 |
| 5,147,044 | A | * | 9/1992 | DiSesa, Jr. | 206/501 |
| 5,617,953 | A | * | 4/1997 | Cope | 206/501 |

FOREIGN PATENT DOCUMENTS

| | | | |
|---|---|---|---|
| CA | 1022090 | A1 | 12/1977 |
| DE | 3937292 | A1 | 5/1991 |
| EP | 0770557 | A1 | 5/1997 |

* cited by examiner

*Primary Examiner*—Anthony Stashick
*Assistant Examiner*—Niki M Eloshway
(74) *Attorney, Agent, or Firm*—Janet Sleath; Speckman Law Group PLLC

(57) ABSTRACT

A nest and stack container system is provided. The system comprises a plurality of containers in various sizes, allowing the stacking of smaller sized containers on a larger sized container. Alternatively, the large container may be stacked on at least two adjacently-arranged small containers. The inventive nest and stack containers allow flexible handling of various sizes of storage containers. Individual containers can be stacked and nested among each other, and in combination, stacks of containers can be formed in any desired sequence of large and small containers, with individual containers each being placed in a slip-proof manner on top of another container.

7 Claims, 5 Drawing Sheets

NEST AND STACKED CONTAINERS

CROSS REFERENCE TO RELATED APPLICATIONS

This application claims priority under 35 U.S.C. §119(a) to Swiss Patent Application No. 560/04, filed Apr. 1, 2004, under 35 U.S.C. §365(a) to International Patent Application No. PCT/CH2005/000149, filed Mar. 14, 2005, and under 35 U.S.C. §120 to International Patent Application No. PCT/CH2005/000149, filed Mar. 14, 2005, and Swiss Patent Application No. 560/04, filed Apr. 1, 2004.

FIELD OF THE INVENTION

The invention generally relates to nest and stack containers.

BACKGROUND OF THE INVENTION

In general, containers used for storing and/or transporting goods are compactly nested in each other when they are empty and placed or stacked on top of each other in a secure and stable manner when they are filled. These storage and transport containers are therefore designed according to a nesting and stacking principal, according to which two similarly aligned containers can be stacked above one another and two oppositely aligned containers can be nested in each other. Different types of such transport containers are known according to this nesting and stacking principle.

DE-297 07 715 U1 discloses a transport container having side walls, arranged in a rectangular way relative to the floor surface, the upper half of which is provided with ribs and handles and the upper half of the side walls is outwardly offset relative to the lower side walls, with the transitional section being formed by a shoulder. The perpendicular side walls comprise positioning elements on their upper edge and stiffening struts on the profiled outer surface and inner perpendicular positioning grooves. Perpendicular feet are arranged on the lower halves, which with respect to dimensions and arrangement are adjusted to each other in such a way that a second container can be nested in one direction in a first container and can be stacked in a reversed alignment. The feet comprise latching springs at their ends on the floor side and latching grooves on the upper edge of the side walls, with the feet being adjusted to the grooves and the latching springs of the feet to the latching grooves of the upper edge in their dimensions so that two containers can be nested in one direction and can be stacked in the opposite direction. The latching grooves of the upper edge of the side walls are dimensionally adjusted to the latching elements of individual feet of a container with half the base surface in such a way that two smaller containers can be stacked in any desired direction on a larger container.

Transport containers without lids are also known. In general, these containers have the shape of reversed truncated pyramids, i.e. they taper downwardly in their cross section and can be nested and stacked according to the nesting and stacking principle. These transport containers also allow stacking two smaller containers in any desired direction on a larger container.

The disadvantage of the transport containers described above is that only smaller containers can be stacked over a larger container, but not vice-versa. The floor surfaces of the containers lie lower than the upper edges of the stacked containers underneath in the case of containers stacked above one another. When a large container is placed for stacking on top of two smaller containers arranged adjacent to each other, its floor surface rests on the adjacent upper edges of the longitudinal sides of the small container and the latching elements on the upper edge of the side walls cannot engage in an interlocking way with the latching elements of the lower side of the container stacked on top. The large container stacked on top of the two smaller containers is thus not securely stacked in a slip-proof way.

Not only it is desirable that small containers can be securely stacked on large containers, but it is also desirable that large containers can be stacked on two adjacently arranged small containers.

SUMMARY OF THE INVENTION

The present invention provides a plurality of nest and stack containers in various sizes, allowing the stacking of smaller sized containers on a larger sized container. Alternatively, the large container may be stacked on at least two adjacently-arranged small containers. The inventive nest and stack containers allow flexible handling of various sizes of storage containers. Individual containers can be stacked and nested among each other, and in combination, stacks of containers can be formed in any desired sequence of large and small containers, with individual containers each being placed in a slip-proof manner on top of another container.

A larger nest and stack container can be combined with a plurality of smaller nest and stack containers. The larger container comprises a floor plate and at least two slightly oblique, outwardly facing longitudinal side walls, and at least two face side walls. The longitudinal side walls each comprise two vertically extending bulges which form at least four feet. The feet are arranged on the opposite longitudinal sides in an offset manner. At its upper end, the larger container forms a circumferential boundary region and the boundary region comprises at the top a rim facing outwardly from upper container edge, which is graduated towards the inside of container and forms support surface on the container edge along the longitudinal side. As a result of the conical shape of container, the floor area is slightly smaller than the opening of the container. As a result, the container can be placed into each other in the same alignment for nesting, with the feet filling into the complementary recesses of the container underneath. To stack a first container onto a second container positioned underneath, the first container is twisted by about 180° relative to the second container positioned underneath.

A smaller nest and stack container is also provided, which is about half the size of the larger container. The longitudinal side of the small container corresponds approximately to the face side of the large container and the face side of the small container corresponds approximately to half the longitudinal side of the large container. The small nest and stack container comprises a floor plate and two slightly oblique, outwardly facing longitudinal side walls and face side walls. The two face side walls each comprise two vertically extending bulges which form the feet of the small nest and stack container. The feet are arranged on opposite face sides in an offset manner. At its upper end, the container forms a circumferential boundary region and boundary region comprises at the top a rim facing outwardly from the upper edge of the container, which is inwardly graduated along the face side and forms the support surface on the container's edge along the face side. The support surface comprises upwardly projecting latching tongues along the face sides.

A large container may be stacked on top of at least two small containers. The feet of the large container rest on the support surfaces of the two smaller containers, and the respectively arranged latching tongues of the smaller container latch into the profiles of the feet. The upper edge of the graduated rim lies in the plane of the support surfaces, and floor plate of the large container rests on the graduated rim. As a result, the large nest and stack container is stacked in a slip-proof and stable manner on the two smaller nest and stack containers.

BRIEF DESCRIPTION OF THE DRAWINGS

The present invention will be described in greater detail in the following detailed description, with reference to the accompanying drawings, wherein.

DETAILED DESCRIPTION OF THE INVENTION

The present invention provides a plurality of nest and stack containers in various sizes, allowing the stacking of smaller sized containers on a larger sized container. Alternatively, the large container may be stacked on at least two adjacently-arranged small containers. The inventive nest and stack containers allow flexible handling of various sizes of storage containers. Individual containers can be stacked and nested among each other, and in combination, stacks of containers can be formed in any desired sequence of large and small containers, with individual containers each being placed in a slip-proof manner on top of another container.

Figure 1:
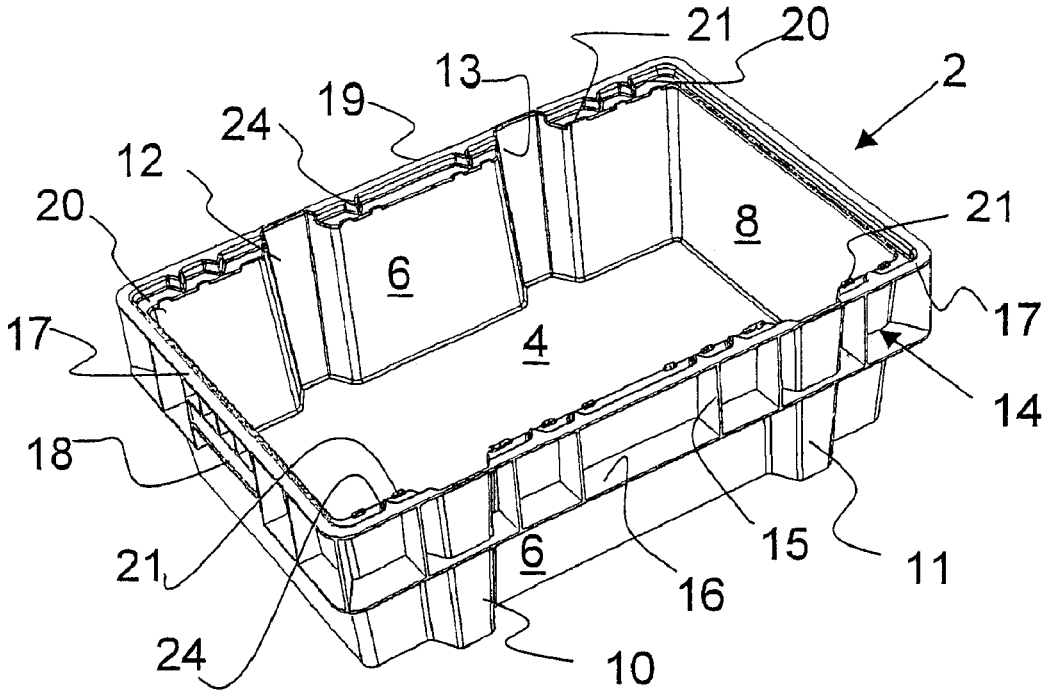
FIG. 1 shows a top perspective view of an embodiment of a larger sized nest and stack container.
Figure 2:
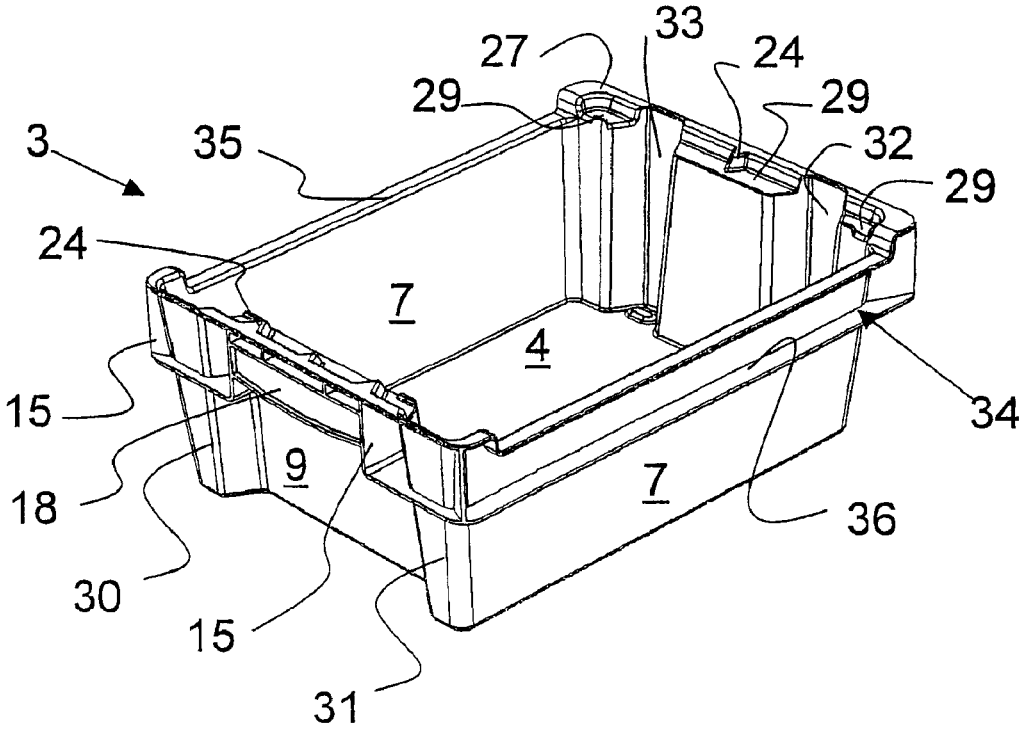
FIG. 2 shows a top perspective view of an embodiment of a smaller sized nest and stack container.

FIG. 1 shows a larger nest and stack container 2 which can be combined with a plurality of smaller nest and stack containers 3, as shown in FIG. 2. Container 2 comprises a floor plate 4 and at least two slightly oblique, outwardly facing longitudinal side walls 6, and at least two face side walls 8. The longitudinal side walls 6 each comprise two vertically extending bulges which form the feet 10, 11, 12, and 13 of the nest and stack container 2. The feet 10, 11, 12, 13 are arranged on the opposite longitudinal sides 6 in an offset manner. At its upper end, the container 2 forms a circumferential boundary region 14. Boundary region 14 comprises at the top a rim 17 facing outwardly from upper container edge 19, which is graduated towards the inside of container 2 and forms support surface 20 on the container edge 19 along the longitudinal side 6. The support surface 20 comprises upwardly projecting latching tongues 21 along the longitudinal side 6. Inwardly facing centering noses 24 are formed on the graduation of rim 17 along longitudinal side 6, which face horizontally inwardly. The bottom end of boundary region 14 is formed by a strip 16, which extends horizontally about the container 2 and is formed on the longitudinal and face side walls 6 and 8. Several vertically extending reinforcing ribs 15 are formed outwardly on the longitudinal and face side walls 6 and 8 between the rim 17 and the strip 16. Side walls 8 may be provided with handles 18.

As a result of the conical shape of container 2, the floor area 4 is slightly smaller than the opening of the container 2. As a result, container 2 can be placed into each other in the same alignment for nesting, with the feet 10, 11, 12, and 13 fitting into the complementary recesses of the container 2 underneath. A first container 2 can thus be nested into a second container 2 positioned underneath until the upper edge of the first container's 2 strip 16 rests on the container edge 19 of the second container. To stack the first container 2 onto the second container 2 positioned underneath, the first container 2 is twisted by about 180° relative to the second container 2 positioned underneath. The feet surfaces of feet 10, 11, 12, and 13 of the upper first container 2 thus come to lie between the centering noses 24 on the support surface 20 of the second lower container 2 and the respectively arranged latching tongues 21 latch into the profiles of the support surfaces of feet 10, 11, 12, and 13. The first and second containers are thus stacked in a slip-proof manner.

FIG. 2 shows a small nest and stack container 3, which is about half the size of the large container 2. The longitudinal side 7 of the small container 3 corresponds approximately to the face side 8 of the large container 2 and the face side 9 of the small container 3 corresponds approximately to half the longitudinal side 6 of the large container 2. The small nest and stack container 3 comprises a floor plate 4 and two slightly oblique, outwardly facing longitudinal side walls 7 and face side walls 9. The two face side walls 9 each comprise two vertically extending bulges which form the feet 30, 31, 32, 33 of the small nest and stack container 3. Feet 30, 31, 32, 33 are arranged on opposite face sides 9 in an offset manner. At its upper end, the container 3 forms a circumferential boundary region 34. Boundary region 34 comprises at the top a rim 27 facing outwardly from the upper edge of the container 3, which is inwardly graduated along the face side 9 and forms the support surface 29 on the container's 3 edge along the face side 9. The support surface 29 comprises upwardly projecting latching tongues 21 along the face sides 9. Horizontally inwardly facing centering noses 24 are formed on the inwardly graduated rim 27 along the face sides 9. The lower end of the boundary section 34 is formed by a strip 36 formed on the longitudinal and face side walls 7 and 9, which surrounds the container 3 horizontally. Vertically extending reinforcing ribs 15 are formed between the rim 27 and the strip 36 on the outside in the corner region of the container 3 and on the face side walls 9. Face sides 8 may be provided with handles 18. The rim 27 is graduated along the longitudinal sides 7, so that the longitudinal face wall 7 comprises a recess in its edge at the upper end. The upper edge of the graduated rim 35 lies in the plane opened up by the support surfaces 29.

Containers 3 are placed into each other in the same alignment for nesting. A first container 3 can thus be introduced into a second container 3 beneath so that the bottom edge of first container's 3 strip 36 rests on the container edge of the lower second container 3. For stacking the small nest and stack containers 3, the first container 3 to be stacked is turned by about 180° relative to the second container 3 positioned underneath. The feet surfaces of feet 30, 31, 32, and 33 of the upper (first) container 3 thus come to lie on the support surface 29 of the bottom (second) container 3 and the respectively arranged latching tongues 21 latch into the latching grooves 37 in feet 30, 31, 32, and 33. The containers 3 are thus stacked in a slip-proof manner.

Figure 3:
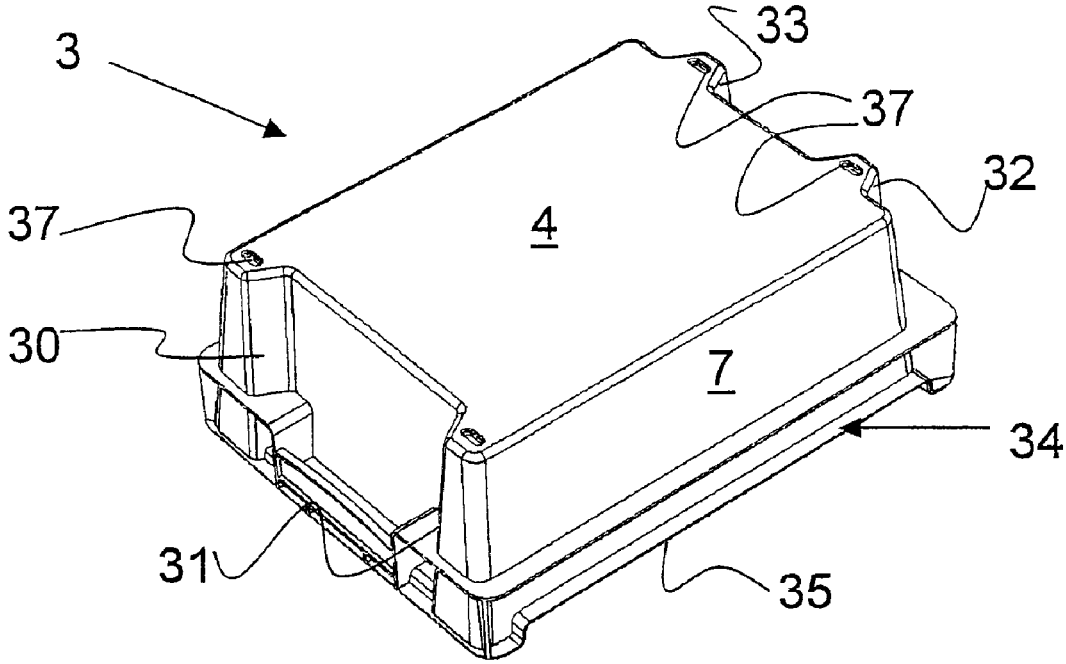
FIG. 3 shows a bottom perspective view of the container shown in FIG. 2.

FIG. 3 shows a bottom perspective view of the small nest and stack container 3 as shown in FIG. 2, showing feet 30, 31, 32, and 33 with the latching grooves 37 in their support surfaces and the upper boundary region 34 of the container 3 with the graduated rim 35 along the longitudinal side 7.

Figure 4:
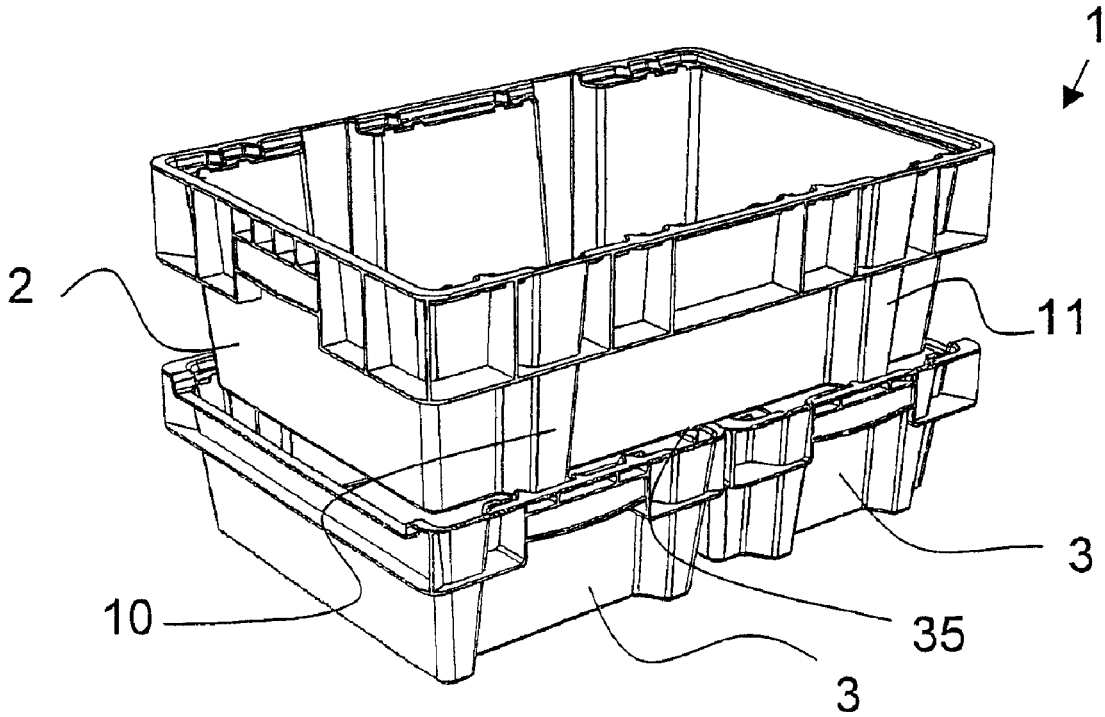
FIG. 4 shows a perspective view of an embodiment of a larger nest and vest container stacked on top of a pair of smaller nest and stack containers.

FIG. 4 shows the combination of a pair of smaller nest and stack containers 3 with a large nest and stack container 2, with large container 2 stacked on top of the small containers 3. The feet 10, 11, 12, and 13 of the large container 2 rest on the support surfaces 29 of the two smaller containers, and the respectively arranged latching tongues 21 of the smaller container 3 latch into the profiles 25 of the feet 10, 11, 12, and 13. The upper edge of the graduated rim 35 lies in the plane of the support surfaces 29, and floor plate 4 of the large container 2 rests on the graduated rim 35. As a result, the large nest and stack container 2 is stacked in a slip-proof and stable manner on the two smaller nest and stack containers 3.

Figure 5:
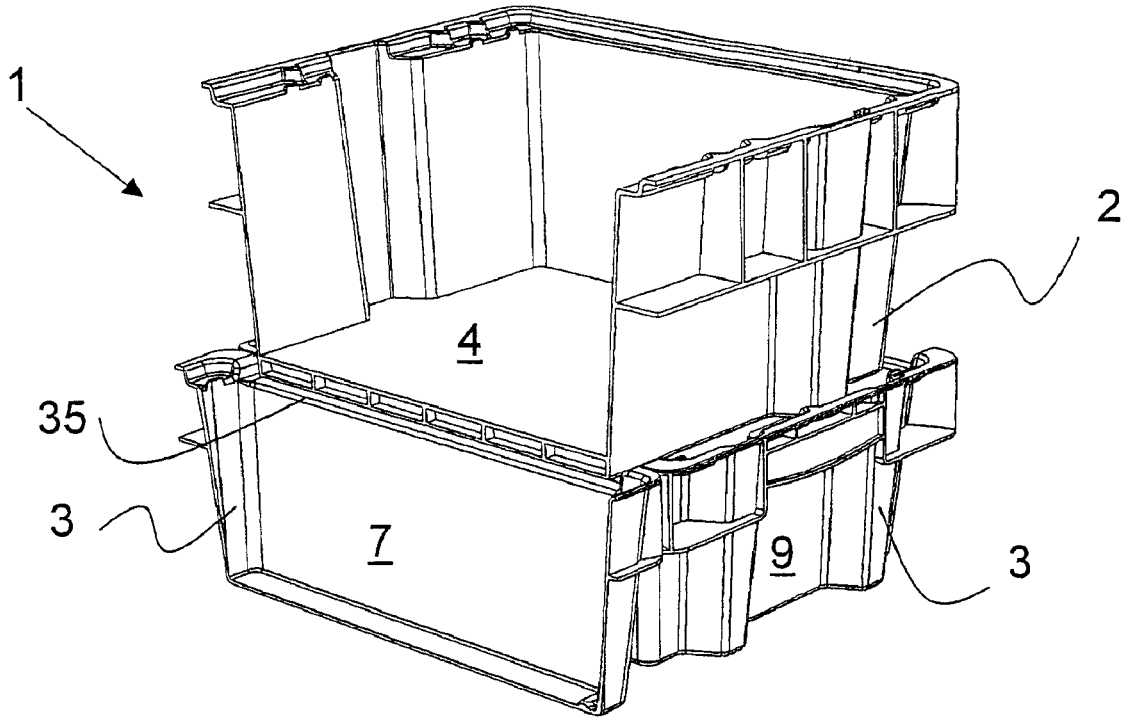
FIG. 5 shows a cross sectional perspective view of the larger nest and vest container stacked on top of the pair of smaller nest and stack containers shown in FIG. 4.

FIG. 5 shows a cross-sectional view through a stack 1 with a pair of smaller containers 3 stacked beneath a large container 2. The section extends vertically in the region close to the longitudinal side wall 7 of smaller container 3. The upper edge of the lower rim 35 and the floor 4 of the large container 2 resting on the same. As shown in FIG. 5, the floor 4 may be provided with a double wall with interposed reinforcing ribs which increase the stability and the carrying capability of the container 2.

Figure 6:
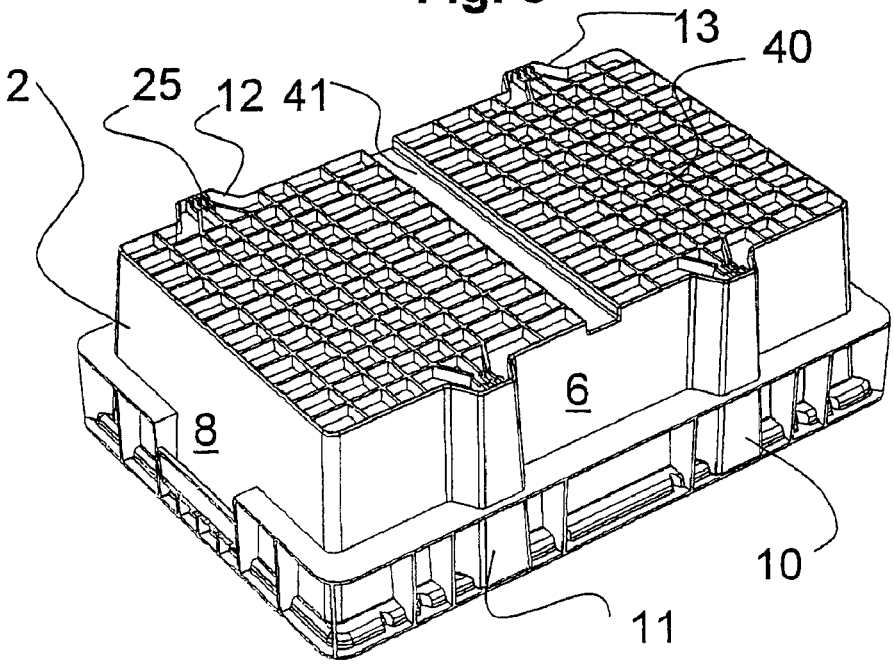
FIG. 6 shows an embodiment of a bottom perspective view of a larger nest and stack container as shown in FIG. 1.

FIG. 6 shows a bottom perspective view of the large nest and stack container 2. The lower side of the container's 2 floor 4 comprises a ribbing 40 with a recess 41. The recess 41 extends at half the length of floor 4 parallel to the face side 8 of the container 2. The width of the recess 41 corresponds approximately to twice the width of the upper edge 35 of the small container 3. Furthermore, profiles 25 can be seen on the bottom side of the feet 10, 11, 12, and 13, into which engage the latching tongues 21 during the stacking of containers 2 and 3.

Figure 7:
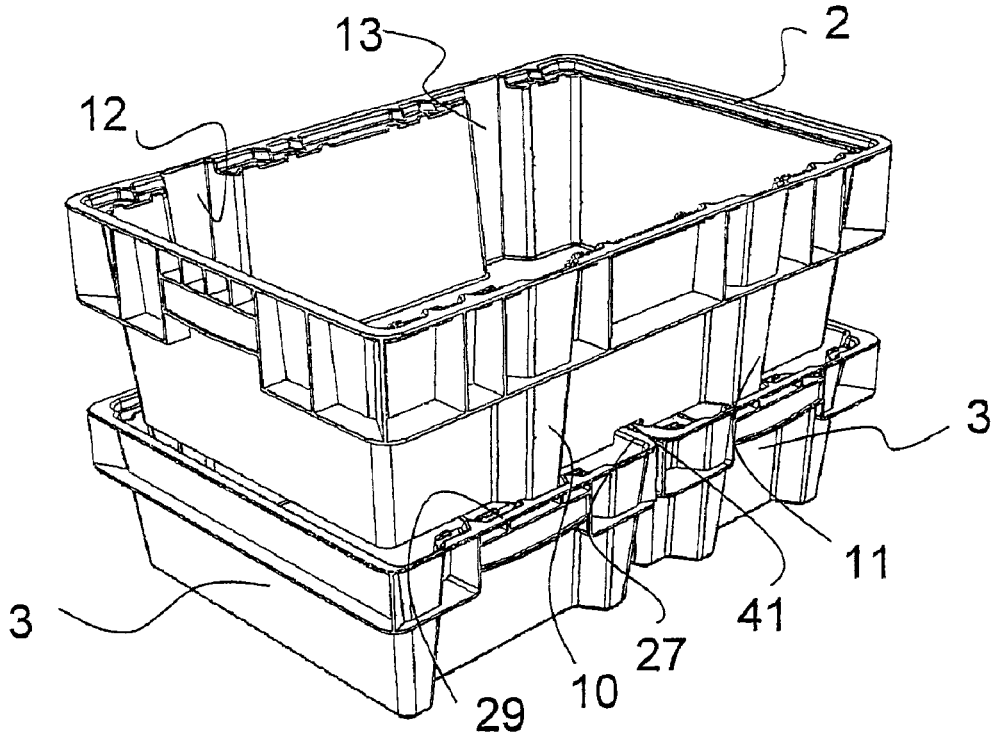
FIG. 7 shows a perspective view of another embodiment of a larger nest and stack container stacked on top of a pair of smaller nest and stack containers.

FIG. 7 shows the combination of a large nest and stack container 2 as shown in FIG. 6 with a pair of small containers 3. In this combination, it is possible to also use small containers 3, as shown in FIG. 2, for stacking, but rim 27 along the longitudinal side wall 7 is not graduated, which means that its longitudinal side wall 7 does not comprise any recess on its upper edge. The recess 41 of the floor 4 of the large container 2 lies above the two adjacently situated rims 27 of the two small containers 3. The stacking of container 2 onto the two smaller containers 3 occurs in the manner as shown in FIG. 4. A large container 2 can be stacked in both alignments on a pair of small containers 3.

Figure 8:
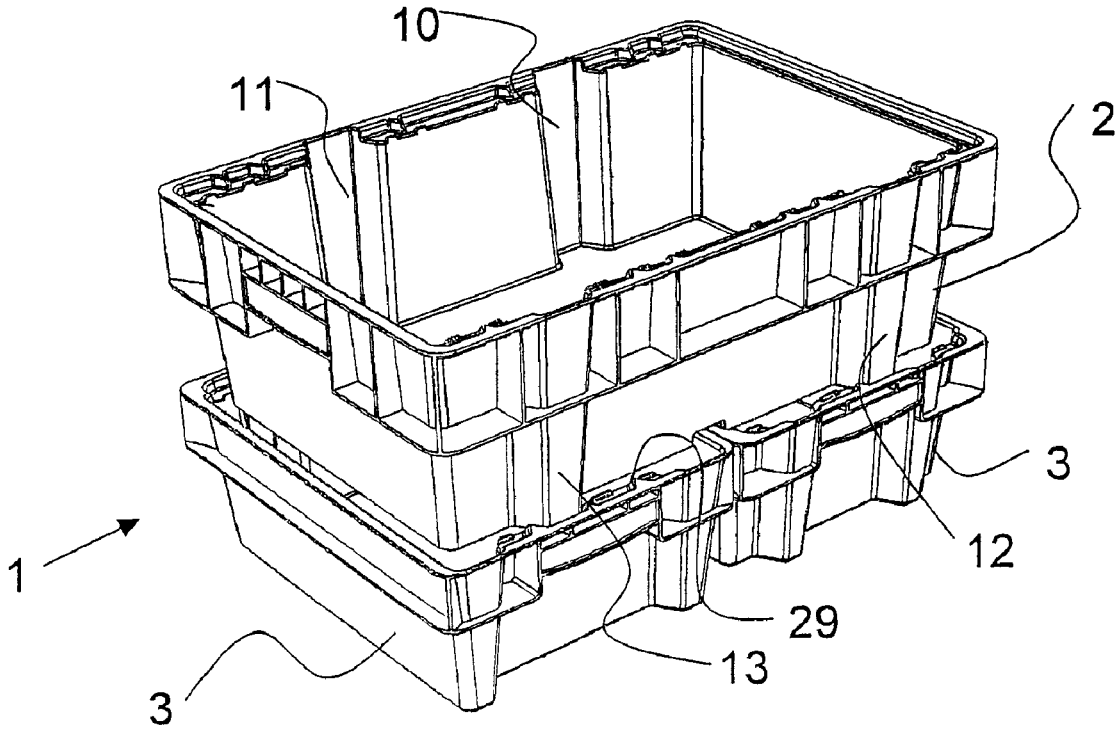
FIG. 8 shows another perspective view of the containers shown in FIG. 7.

FIG. 8 shows a stack 1 of a large container 2 and two small nest and stack containers 3, with the large container 2 being turned by about 180° relative to the container 2 shown in FIG. 7. The feet 10, 11, 12, and 13 of the large container 2 rest on the support surfaces 29 of the two small containers 3. The large nest and stack container 2 is thus stacked in both alignments in a slip-proof and stable manner on the two smaller nest and stack containers 3.

Figure 9:
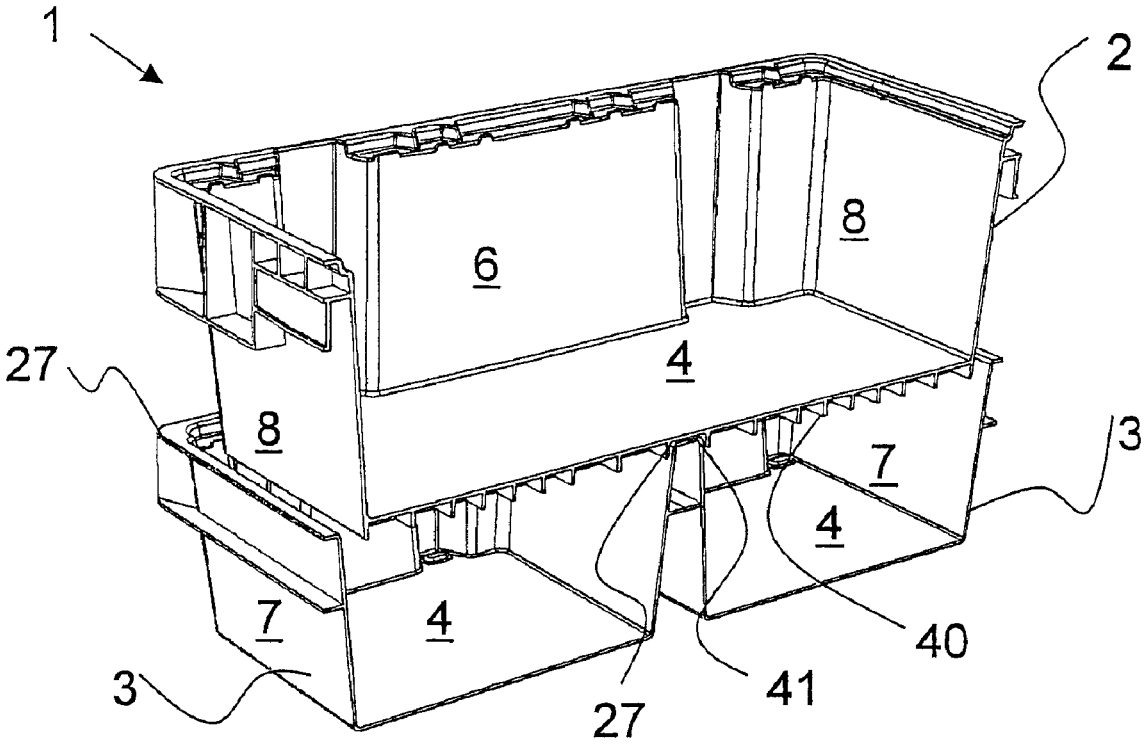
FIG. 9 shows a cross sectional perspective view of the containers shown in FIG. 7.

FIG. 9 shows a cross-sectional view of a stack of a pair of small containers 3 stacked beneath a large container 2. The sectional extends vertically parallel to the longitudinal side of the large container 2. The two rims 27 of the two adjacently situated small containers 3 engage in the recess 41 of the ribbing 40 of floor 4. The floor 4 of the large container 2 rests on the rims 27 of the small containers 3. The illustrated floor 4 is ribbed and open on its lower side. A double-wall floor with interposed reinforcing ribs is also possible, i.e. with downwardly covered ribs. A simple, non-ribbed floor is also possible in a simple embodiment. Thus, recess 41 is formed by a U-profile which runs transversally through the container and is downwardly open-.

A highly flexible system of storage and transport containers is thus provided by the possibilities for the various combinations of large and small nest and stack containers 2 and 3. Very large and small containers 2 and 3 can be stacked in random sequence. It is also possible to stack nested containers 2 and 3. For example, a number of large containers 2 can be combined into stacks in a nested manner with a number of small nested containers 3.

While certain embodiments of the present invention have been described, it will be understood that various changes may be made in the above invention without departing from the scope of the invention. It is intended that all matter contained in the above description or shown in the accompanying drawings shall be interpreted as illustrative and not in a limiting sense.

The invention claimed is:

1. A nest and stack container system, comprising:

(a) a large container; and (b) two small containers, each of the two small containers being substantially half the size of the large container and being stackable on the large container in a slip-proof and stable manner and wherein a floor of the larger container and upper edges on a longitudinal side of each of the small containers are arranged in such a way that the large container can also be stacked on two adjacently arranged small containers, wherein the small and large containers each comprise:

(i) two slightly oblique, outwardly facing longitudinal side walls and two face side walls, wherein the face side walls of the small containers and the longitudinal side walls of the large container each comprise two vertically extending bulges that form feet, and (ii) a circumferential boundary region positioned at an upper end of each container, wherein a top of the boundary region is provided with a rim that faces outwardly from an upper container edge and is inwardly graduated along the face side walls of the small containers and the longitudinal walls of the large container to form a support surface along the face side walls of the small containers and along the longitudinal walls of the large container, wherein the support surfaces comprise upwardly projecting latching tongues and the feet comprise profiles on their bearing surfaces that form latching grooves, such that the latching tongues engage with the latching grooves when the large and small containers are stacked.

2. The nest and stack container system of claim 1, wherein the rim of each of the small containers is graduated in the region of the longitudinal sides, whereby each of the longitudinal side walls comprises a recess on its upper edge, and the upper edge lies along the recess in a plane opened up by the support surfaces.

3. The nest and stack container system of claim 1, further comprising a plurality of horizontally inwardly facing centering noses formed on the inwardly graduated rim provided along the face side walls of the small container.

4. The nest and stack container system of claim 1, wherein the bottom end of the boundary region of the large container is formed by a strip formed on the longitudinal and face side walls which extends horizontally circumferentially about the large container.

5. The nest and stack container system of claim 1, wherein the lower side of the floor of the large container comprises a ribbing provided with a recess that extends at about half the length of the floor of the large container parallel to the face side wall of the large container and has a width which corresponds approximately to twice the width of the upper edge of one of the small containers.

6. The nest and stack container system of claim 5, wherein a bottom side of the floor of the large container is covered in the area of the ribbing, such that the bottom side of the floor forms a smooth surface.

7. The nest and stack container system of claim 1, further comprising horizontally inwardly facing centering noses formed on the inwardly graduated rim along the longitudinal sides of the large container.

* * * * *

UNITED STATES PATENT AND TRADEMARK OFFICE

CERTIFICATE OF CORRECTION

PATENT NO. : 7,721,891 B2
APPLICATION NO. : 11/537580
DATED : May 25, 2010
INVENTOR(S) : Jean-Marc DuBois It is certified that error appears in the above-identified patent and that said Letters Patent is hereby corrected as shown below:

| | Line(s) | Edits |
|---|---|---|
| Title page item 22 | (-) | **Replace** "Filed: Sep. 29, 2006," with the following column numbers and lines:<br><br>"PCT Filed: Mar. 10, 2005<br><br>(86) PCT No.: PCT/CH2005/000149<br><br>§ 371 (c)(1), (2), (4) Date: Sep. 29, 2006<br><br>(87) PCT Pub. No.: WO2005/095217<br><br>PCT Pub. Date: Oct. 13, 2005 |
| Title page item 65 | (-) | **After** "Feb. 15, 2007," **add** the following column numbers and lines:<br><br>(30) **Foreign Application Priority Data**<br><br>Apr. 1, 2004 (CH) ..... 560/04 |

Signed and Sealed this

Tenth Day of August, 2010

David J. Kappos

David J. Kappos
*Director of the United States Patent and Trademark Office*